US006116598A

United States Patent [19]

Maythenyi

[11] Patent Number: 6,116,598

[45] Date of Patent: Sep. 12, 2000

[54] BRIDGE BIDDING AND DISPLAY DEVICE

[76] Inventor: Charles R. Maythenyi, Box 150, Maythenyi Dr., South Fallsburg, N.Y. 12779

[21] Appl. No.: 09/414,699

[22] Filed: Oct. 7, 1999

[51] Int. Cl.[7] ..... A63B 71/00

[52] U.S. Cl. ..... 273/148 R; 273/148 A; 273/148 B; 273/293

[58] Field of Search ..... 273/148 A, 148 R, 273/148 B, 293

[56] References Cited

U.S. PATENT DOCUMENTS

| | | | |
|---|---|---|---|
| D. 172,471 | 6/1954 | Killoren | D34/13 |
| 1,656,993 | 1/1928 | Searle | 273/148 R |
| 2,029,928 | 2/1936 | Krantz | 273/148 |
| 2,180,873 | 11/1939 | Hill | 273/148 |
| 2,913,137 | 11/1959 | Alatorre | 220/20 |
| 2,932,518 | 4/1960 | Burros | 273/137 |
| 3,420,526 | 1/1969 | Berger | 273/148 |
| 3,729,216 | 4/1973 | Hahto et al. | 281/45 |
| 3,917,275 | 11/1975 | Alpher | 273/136 A |
| 4,030,764 | 6/1977 | Mattos | 273/148 A |
| 4,900,027 | 2/1990 | Sheridan | 273/148 R |
| 5,037,110 | 8/1991 | Haskel | 273/293 |
| 5,377,982 | 1/1995 | Villareal, Jr. | 273/148 R |

*Primary Examiner*—Jeanette Chapman
*Assistant Examiner*—D Collins
*Attorney, Agent, or Firm*—Sandra M. Kotin

[57] ABSTRACT

A bridge bidding device having a keypad visible only to the user and a display board visible to the other players. The keypad and display board are each arranged in two rows of ten blocks. The keypad has bidding indicia on each block that includes the numbers one through seven, the four card suits and NT, and PASS, DBL, REDBLE, SKIP BID and ALT. The keypad also has the control indicia for BID, ER and CLOSE. The keypad blocks are also touchpads for the transmission of the bidding and control information. The top row of the display board can exhibit the numbers one through seven and PASS, DBL, REDBLE, SKIP BID and ALT. The bottom row of the display board can exhibit the four card suits and NT. The bidding information is exhibited by means of light emitting diodes. A large-scale silicon integrated active component and support components mounted on a multilayer printed circuit board controls the accumulation and dissemination of information. Bids by a single player for a given hand are made on the keypad and displayed in sequence on the display board. One device is used by each player during the game of bridge.

13 Claims, 3 Drawing Sheets

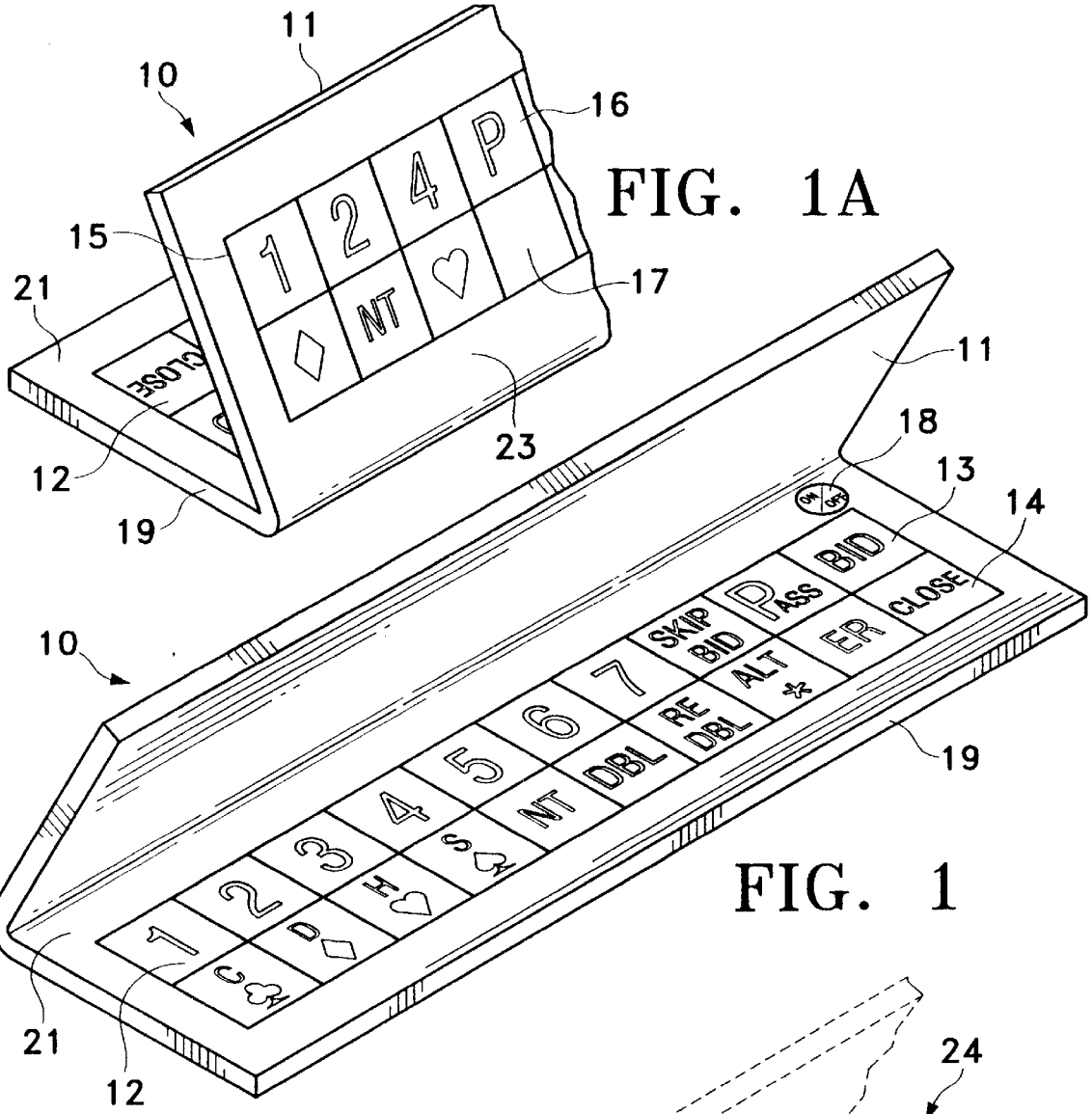
FIG. 1A
FIG. 1
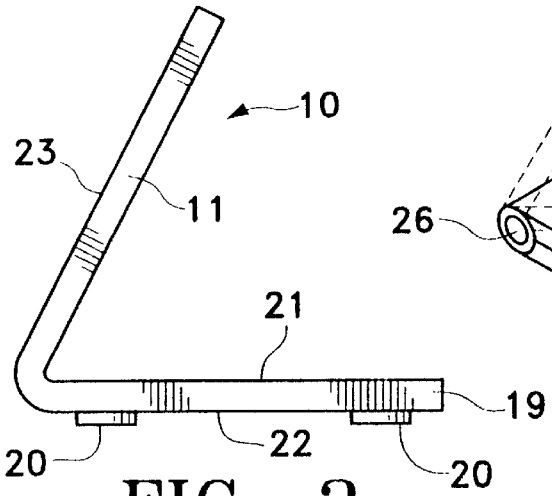
FIG. 2
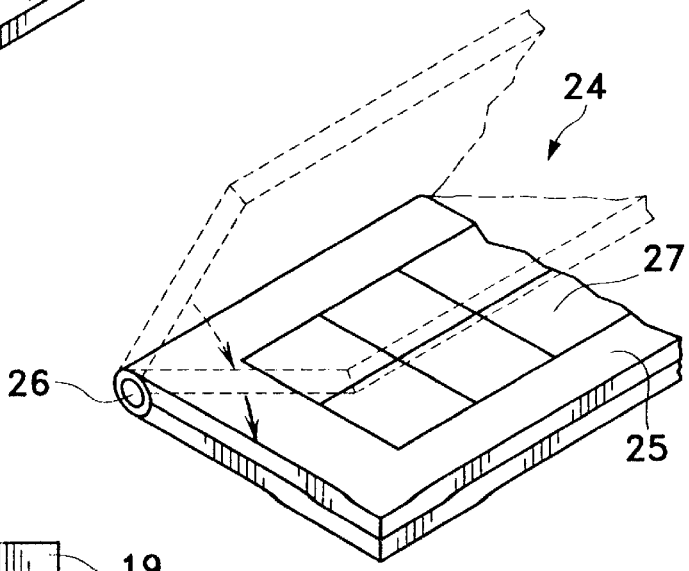
FIG. 3

BRIDGE BIDDING AND DISPLAY DEVICE

FIELD OF THE INVENTION

The instant invention relates to a device for registering and displaying a sequence of bids for card games and more particularly for the game of bridge.

BACKGROUND OF THE INVENTION

The game of bridge involves bidding by each player in turn until a final bid is accepted and the hand is played. A means to display the sequence of bids is important so that each player retains his or her conception of the cards held by the other players and so that no oral commentary is needed to clarify or reiterate one or more bids. In contract bridge it is also necessary that the bids be silent so as not to include voice inflections that may convey more meaning than the bid itself and so as not to interfere with the concentration of the players at the other tables. A number of devices have been developed to display the bids and to completely eliminate oral communication during games of bridge.

A bridge bidding board was disclosed by Searle in U.S. Pat. No. 1,656,993, which contained a series of boxes in a grid of five columns and seven rows. Each column represented one of the card suits and no trump while the rows were numbered in sequence, 1 through 7. Each of the boxes had a hole for a peg, and there were different pegs for each player. The players inserted their pegs in the appropriate boxes to indicate their bids. A separate row of boxes was reserved for recording passes. One peg was used to indicate "double" while a second peg was inserted into the first for "redouble". A score sheet was affixed to the board. This system was quite cumbersome. The board would have to be passed from player to player for each player to mark his or her bid. The pegs could easily be placed in the wrong positions and could become dislodged as the board was passed around the table. The correct numbers and types pegs had to be maintained and kept with each board.

Krantz, in U.S. Pat. No. 2,029,928 disclosed a game board or table designed specifically for the game of bridge. The board consisted of two layers. Mechanical levers and wheels were located between the layers and were used to record and exhibit the bidding which was displayed through windows in the upper layer. The board accommodated four players, each having access to four finger pieces controlling the levers and wheels. The board was also equipped with a snap acting device that made an audible sound each time a setting was changed. This device was clumsy and difficult to transport and store. The audible sound made it impractical for use in contract bridge where quiet and lack of distractions are essential.

Another game board, that rested on top of a card table, was developed by Hill (U.S. Pat. No. 2,180,873). The board was made of cardboard and hinged so that it could be folded down the middle for storage. Two rows of depressions were located in front of each player. The first row had seven depressions for bidding and the second row four depressions which were marked 'original bid' for the introduction of a new suit. Each player had a number of markers for indicating each suit and no trump. The markers were stored in depressions at the side of the player. A score sheet was also provided. Though this board could be folded, the markers would have to be removed to a container or they would become dislodged during the folding and lost when the board was moved. Maintaining a number of such boards and setting them up with all of the markers in their proper depressions required considerable time and would not be practical for large groups playing contract bridge.

An electronic bridge bidding device consisting of four consoles connected to four individual display boards or to one central display board was disclosed by Berger in U.S. Pat. No. 3,420,526. The consoles and display boards could be built into a table or constructed as separate portable units. Each console was shielded so that it could only be seen by the player using it. A bid was displayed on the display board when it was entered on a player's console. Each console had a reset button to clear a bid before the next bid was entered. The central display board could be constructed to show the current individual bid or to display all bids for a given hand. The consoles and display boards had indicia that permitted recording all bids for the four suits, and no trump, as well as pass, double and redouble. Electric bulbs behind the panels were lighted to indicate each bid. All of the consoles had to be wired to the display board or boards and when all were part of a table the table could only be used for games of bridge. The units were not easy to store and transport due to their size, configuration and to the necessary connecting wires. If portable units were used the connecting wires would extend across the table and get in the way of the playing surface. There was no way for a player to correct a bid made in error since the bids showed up on the display board as they were entered on the console.

Mattos, in U.S. Pat. No. 4,030,764, disclosed a single frame portable electronic unit containing both a bidding section and a display section that recorded all of the bids during a given hand. The frame also had storage room for two decks of cards. Indicia were present to record every possible bid and to display the bids sequentially and by player. If one player or observer was to record the bids they would have to be tendered orally, if not, the frame would have to be passed from player to player so that each could enter his or her bid in turn. Since oral bidding is not permitted during contract bridge, the passing of this unit from player to player would be distracting and undesirable.

There is a need for a simple, small portable unit that can be used to enter and display the bids of each player, that can remain in front of each player throughout the game, and that can easily be stored and transported. There is a need for such a unit having a display panel that can be observed by all players so that the bidding can be reviewed as it progresses and then can be cleared when the hand is played. There is a need for a small, compact unit that takes up little room on the table and has no wires to interfere with the playing surface.

BRIEF SUMMARY OF THE INVENTION

Recent developments in microprocessors and printed circuits make the use of small independent bridge bidding devices possible. The present invention provides a bridge bidding device which takes up little room on the table, can be set in front of each player, and is capable of accepting and displaying each bid by a particular player and thereafter clearing those bids once the hand is begun.

It is therefore an object of the present invention to provide a small, self-contained bridge bidding device with no exterior wires or connections.

Another object of the present invention is to provide a bridge bidding device that will satisfy all of the requirements of contract bridge and the bidding process and record all bids without vocal interference.

A further object of the present invention is to provide an electronic bridge bidding device having controlled sequencing, printed circuit boards and touch pads that illuminate on contact.

A still further object of the present invention is to enable each player to make changes in his or her bid before having that bid displayed on the display board.

Another object of the present invention is to have a device that clears the bidding keypad when a bid is entered on the display board.

A further object of the present invention is to provide a battery operated bridge bidding device that is easy to use, transport and store, and which requires no maintenance.

A still further object of the present invention is to provide a bridge bidding device that utilizes printed circuits to make manufacturing inexpensive and uncomplicated.

An object of the present invention is to have a bridge bidding device equipped with skid-proof pads so that once set in place on the table it is not easily dislodged.

A further object of the present invention is to provide a bridge bidding device where the player's keypad is only visible to that player while the display board is visible to all others at the table.

Another object of the present invention is to have a bridge bidding device with L.E.D. displays to simplify the internal requirements.

The instant invention is a device for use by a bridge player to register and display sequential bids during a given hand of play. The bridge bidding device has a housing, a keypad including a multiplicity of manipulable means, each of which exhibits indicia indicative of bidding information or control information and each of which is electrically actuated when manipulated; a display board including a multiplicity of electrically actuable blocks, each of which contains means for registering and displaying a plurality of indicia indicative of bridge bidding information; main control means for accepting, sorting, sequencing and routing electrically transmitted information; and electrical circuit means for transmitting electrically transmitted information from the keypad to the main control means, from the main control means to the display board and from the main control means to the keypad; and a power source.

Other features and advantages of the invention will be seen from the following description and drawings wherein similar reference characters are used to designate corresponding parts in all views.

BRIEF DESCRIPTION OF THE DRAWING

FIG. 1 is a rear perspective view of the bridge bidding device of the instant invention;

FIG. 1A is a partial front perspective view of the device of FIG. 1;

FIG. 2 is side plan view of the device of FIG. 1;

FIG. 3 is a partial perspective view of another embodiment of the bridge bidding device;

DETAILED DESCRIPTION OF THE INVENTION

Figure 4:
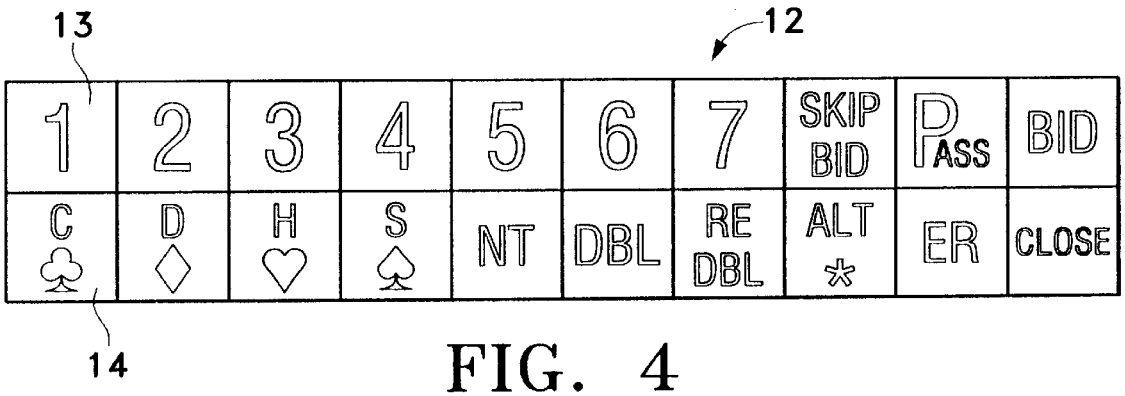
FIG. 4 is a plan view of the keypad.

Referring to the drawing, FIGS. 1 and 1A show the bridge bidding device 10 which may be contained in a housing 11 configured in the form of two rectangular boards joined along their longitudinal edges. The housing 11 may be V-shaped in cross section as seen in FIG. 2. The housing 11 may be hollow and have a keypad 12 which may be visible only to the player using the device 10, and a display board 15 that may be visible to the other players at the table. Each player may use his or her own bridge bidding device 10 during the game. There may be four units on the table so that each player may be able to see his own keypad and the display boards of the other three players.

One board or leg of the V-shaped housing 11 may rest on the bridge table (not shown) and serve as the base 19 of the device 10. The keypad 12 may be disposed on the upper surface 21 of the base 19. The other board or leg of the housing 11 may be at an acute angle with respect to the base 19 and contain the display board 15 on its front surface 23. Both the keypad 12 and the display board 15 may be divided into two rows of ten blocks each. These will be further described below.

The under surface 22 of the base 19 of the housing 11 may be fitted with skid proof pads 20 to prevent movement of the device 10 during play. The pads 20, seen in FIG. 2, may be small and attached at each corner, or they may be in the form of strips running longitudinally or transversely. Such pads are well known in the art.

Each of the blocks in the two rows of the keypad 12 may exhibit bidding or control symbols as seen in FIGS. 1 and 4. These blocks may themselves be the touch pads for entering a bid or a control instruction. An alternate design (not shown) may have an additional button associated with each block to enter the desired information. All of the touch pads on the keypad 12 may be equipped with light bulbs or other lighting means known in the art so that when a touch pad is pressed to indicate a bid or control instruction the block becomes lighted. There may be seventeen bidding touch pads and three control touch pads on the keypad 12.

The keypad top row 13 may contain nine bidding touch pads and one control touch pad. The bidding touch pads on the keypad top row 13 may exhibit the numbers one through seven, indicating the number of tricks being bid, and the symbols "PASS" and "SKIP BID". The numbers one through seven are sufficient to register all possible bids in a given hand of bridge. The bidder contracts to make six tricks plus the number of tricks bid, up to a maximum of seven. The total number of tricks possible in any one hand of play is thirteen. The meaning of the symbol "PASS" is well known to bridge players. In contract bridge a player must indicate when a bid is to be made that is more than one increment higher than the previous bid. In other words, when a jump bid is being made. This may be indicated by the use of the "SKIP BID" touch pad. This designation may be entered and displayed on the display board 15 before the jump bid is entered and displayed.

Also located on the keypad top row 13 may be the control touch pad exhibiting the symbol "BID". This control touch pad may be used after a player has indicated his bid or other designation such as "PASS" on his keypad 12 and is satisfied that it is the bid he wishes to have transferred to his or her display board 15. The "BID" control touch pad may effect this transfer, and remove the bid from the keypad 12 at the same time.

The keypad bottom row 14 may contain eight bidding touch pads and two control touch pads. The bidding touch pads may exhibit the symbols for each of the four card suits, clubs, diamonds, hearts and spades, and "NT" for a no trump bid, as well as "DBL" for double, "REDBL" for redouble, and "ALT". The two control touch pads may exhibit the symbols "ER" and "CLOSE". The terms double and redouble are well known to bridge players.

Current rules of contract bridge require that a player alert the others if he or she will be using an unconventional bidding system. The "ALT" touch pad may be used under such circumstances immediately prior to making the bid using the unconventional bidding system. The "ALT" may be transferred to the display board 15 by means of the "BID" control touch pad. Thereafter, the unconventional bid may be made and likewise transferred to the display board 15.

A bid may be made by pressing the touch pad or touch pads needed. For example, if a player wishes to bid "one diamond" the touch pad exhibiting "one" on the keypad top row 13 may be pressed as well as the touch pad exhibiting "D" or the conventional symbol for diamonds on the keypad bottom row 14. Both blocks may be lighted and constitute a single bid. If the player wishes to pass or double, only the one appropriate keypad is pressed. Each bid may be transferred to the display board 15 using the "BID" control touch pad.

The "ER" touch pad in the keypad bottom row 14 may be used to erase a bid that has been registered on the keypad 12 but not yet transferred to the display board 15. This may be. used if a player changes his or her mind before the bid has been transferred to the display board 15, or if the player has pressed the wrong touch pad or touch pads in error. When the bidding is completed none of the players will have a bid registering on his or her keypad 12 since all bids will have been transferred to the display board 15. The last control touch pad on the keypad bottom row 14, the "CLOSE" control touch pad, may then be used to erase the entire display board 15 at the conclusion of the bidding when the hand is to be played.

Figure 5:
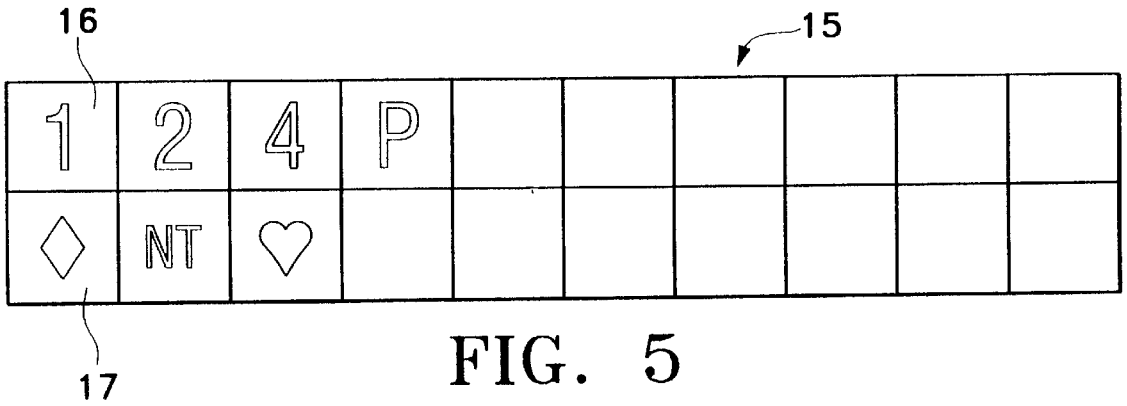
FIG. 5 is a plan view of the display board showing a series of bids.

The display board 15 as seen in FIG. 5 may be provided with two rows of display blocks. There may be ten such display blocks in each row, each being equipped with a lighted indicator that may be in the form of a light emitting diode, or L.E.D., capable of displaying the necessary bidding numbers and symbols as noted above. Each of the display blocks in the display board top row 16 may have the capabilities of displaying the numbers one through seven and symbols indicating "SKIP BID", "PASS", "DBL", "REDBL", and "ALT". The specific symbols to be used for these bids may be devised according to the capabilities of the L.E.D. Each of the display blocks in the display board bottom row 17 may have the capabilities of displaying the symbols for the four card suits and "NT". If the L.E.D.s in the bottom row 17 cannot display the conventional symbols for the four card suits, the letters "C" for clubs, "D" for diamonds, "H" for hearts, and "S" for spades may be used as effectively.

The bidding indicia seen in FIGS. 1A and 5 may be illustrative of one player's display board 15 in the fourth round of bidding in a single hand of play. In the first round of bidding the player has bid "one diamond", in, the second round the same player has bid "two no trump", in the third round "four hearts", and in the fourth round the player has passed. As can be seen from FIGS. 1A and 5, the bids of a single player may be registered from left to right on the display board 15 of that player's unit as viewed from the front.

Figure 7:
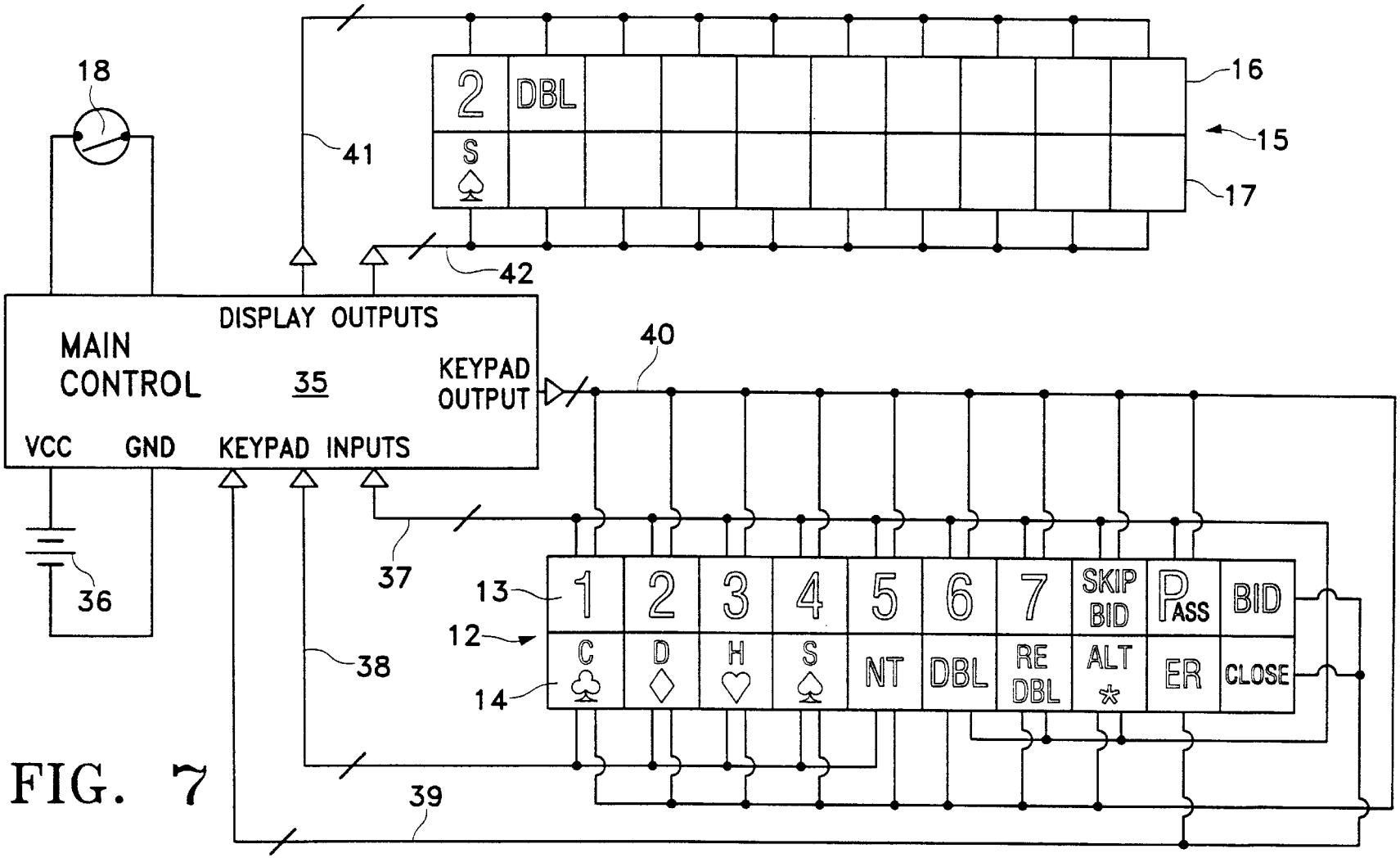

A player's display board 15 may also be seen in FIG. 7. That board may represent two rounds of bidding. In the first round the player has bid "two spades" and in the second round that player has doubled.

A separate device on/off 18 in the form of a button or touch pad may be present at a location on the housing 11 that is separate from the keypad 12. The device on/off 18 may be used to activate or deactivate the device 10 so that the power source which may be a battery 36, or other DC source, can be conserved. A panel or door (not shown) may be provided at a convenient location in the housing 11 through which to replace a battery.

A second embodiment 24 of the bridge bidding device 10 is shown in FIG. 3. The second embodiment housing 25 may be similar to the housing 11 of the bridge bidding device 10 but may be hinged or otherwise movable by a pivot 26 at the apex of the V so the unit can be closed for storage and transport. When the second embodiment 24 is closed or folded, the second embodiment display board 27 may be on the outside while the keypad is covered and cannot be seen or disturbed. There may also be skid proof pads (not shown) on the bottom.

Figure 6:
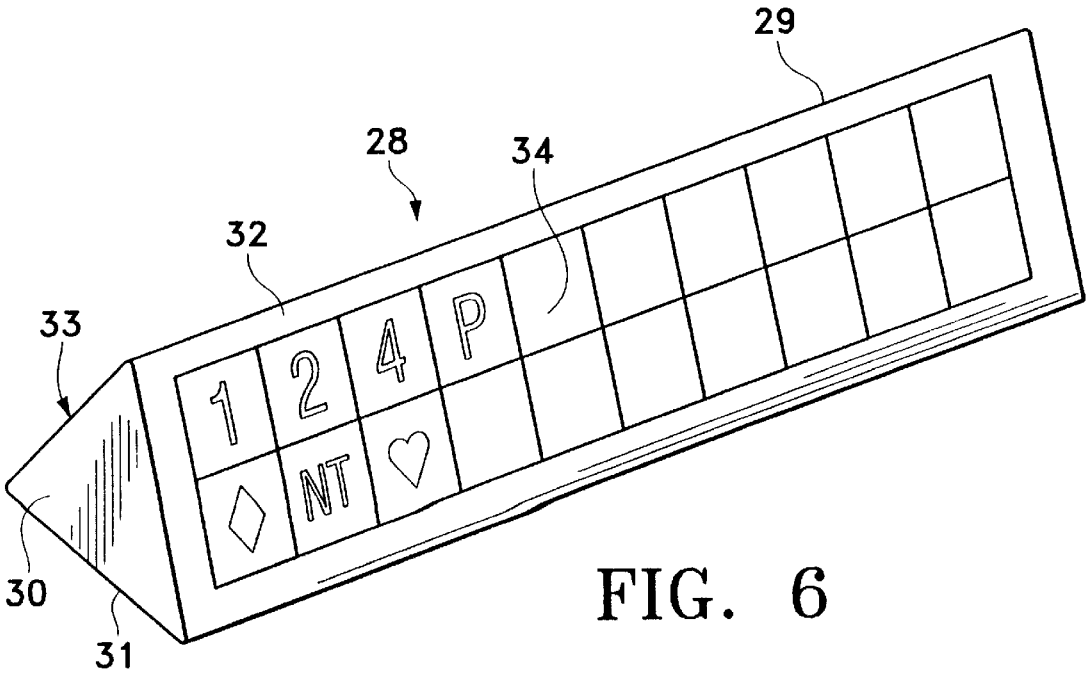
FIG. 6 is a front perspective view of a third embodiment of the bridge bidding device and FIG. 7 is a block diagram illustrating the design intent for the bridge bidding device.

A third embodiment 28 of the instant invention may have a housing 29 in the shape of an elongated three dimensional geometric figure with a triangular cross section. This housing 29 may have three surfaces and triangular end faces 30 as shown in FIG. 6. One surface may form the base 31. The display board 34 may be disposed on the second surface, the front face 32, and the keypad (not shown) may be disposed on the third surface, the rear face 33. Skid proof pads (not shown) may also be affixed to the base 31.

Referring again to FIG. 7, a block diagram illustrating the design intent of the bridge bidding device 10 is seen. There may be a main control unit 35 that manages all of the functionality of the device 10. The functions may be divided into several primary tasks, device on/off, power input, keypad inputs, keypad output and display outputs. The device on/off 18 may control whether the device 10 is active or not. The power input port (VCC) may connect the power source, a battery 36, to the device 10. (Other DC sources may be used.)

The keypad inputs may connect the three keypad buses, upper keypad input bus 37, lower keypad input bus 38 and control keypad input bus 39, to the main control unit 35. The upper keypad input bus 37 may carry the signals which are activated by the user via the "1", "2", "3", "4", "5", "6", "7", "SKIP BID", "PASS", "ALT", "DBL" and "REDBL" bidding touch pads. The lower keypad input bus 38 may carry the signals activated by the user via the "C", "D", "H", "S" and "NT" bidding touch pads. The control signals via the "ER", "CLOSE" and "BID" control touch pads may be carried by control keypad input bus 39 when activated by the user.

The keypad output may connect the keypad output bus 40 to the main control unit 35. The keypad output bus 40 may carry those signals that are used to activate the light indicators that may be mounted within each touch pad of the keypad 12 in response to the selection made by the user as well as the signals to deactivate the light indicators in those touch pads when the "BID" touch pad is activated to transfer bidding information to the display board 15 or when the "ER" touch pad is activated to erase a bid made in error.

The display outputs may connect the two display output buses, the upper display output bus 41 and the lower display output bus 42 to the main control unit 35. The upper display output bus 41 may carry the signals used to activate the light indicators or L.E.D.s that may be mounted in the top row 16 of the display board 15, while the lower display output bus 42 may carry the signals used to activate the light indicators or L.E.D.s that may be mounted in the bottom row of the display board 15. These two display output buses may also carry the signals to deactivate the L.E.D.s when the entire display board 15 is to be deactivated via the "CLOSE" control touch pad.

The main control unit 35 may be responsible for accepting, sorting, processing and routing the information received, as well as the sequencing of the bidding information so that the proper blocks of the display board 15 are activated in correct order and both one block bids, i.e. "PASS" or "DBL" and two block bids, i.e., "two diamonds" may be entered in the proper blocks.

The main control unit 35 may be realized by state of the art electronic technology employing large-scale silicon integrated active components and support components all mounted on a multilayered PCB (Printed Circuit Board).

The design of the keypad 11 and display board 12 may be varied as to the particular number and arrangement of blocks so long as the number of blocks and their display capabilities are sufficient to accommodate the requisite bidding symbols, sufficient rounds of bidding and the necessary controls.

The housings for each embodiment may be made of a suitable plastic or other rigid material. The display board need only have blocks in the form of transparent windows through which the L.E.D.s are visible. These windows may be flush with the surface of the housing. The keypad may have blocks with the necessary indicia printed thereon. These blocks may be transparent or translucent, with a light source beneath each block. The blocks themselves may be the touch pads, or, as noted above, additional buttons may be associated with each block to function as the activation means. The design intent as seen in FIG. 7, including the main control unit and support components, may be the same for all embodiments. The shapes and sizes of the main control unit and support components may be configured to fit within the particular housing used.

While three embodiments of the present invention have been illustrated and described in detail, it is to be understood that this invention is not limited thereto and may be otherwise practiced within the scope of the following claims.

What is claimed is:

1. A bridge bidding and display device comprising:

housing means for containing said device, said housing means having at least two faces, a first face visible only to a user and a second face visible to an observer;

a keypad disposed on said first face, said keypad including a multiplicity of manipulable means, each of which exhibits indicia indicative of bidding information or control information and each of which is electrically actuated when manipulated, said bidding information including the suit bid or no trump, the number of tricks, pass, double, re-double, a jump/skip bid and an unconventional bidding system, and said control information including means to cancel a bid made in error before it is entered, means to enter a bid, and means to erase all bids at the conclusion of the bidding;

a display board disposed on said second face, said display board including a multiplicity of electrically actuable blocks, each of which contains means for registering and displaying a plurality of indicia indicative of bridge bidding information, said blocks being arranged in sets of two blocks, each set being capable of registering one bid or other bidding information including pass, double, re-double, a jump bid or an unconventional bidding system, as required in a round of bidding, the number of sets being sufficient to accommodate the required bidding information and number of rounds of bidding in a hand of bridge;

main control means, disposed within said housing means, for accepting, sorting, sequencing and routing electrically transmitted information, said main control means comprising silicon integrated active components and support components mounted on printed circuit boards; and electrical circuit means, disposed within said housing, for transmitting electrically transmitted information from said keypad to said main control means, from said main control means to said display board, and from said main control means to said keypad, said electrical circuit means comprising at least one keypad input bus, at least one keypad output bus, and at least one display output bus.

2. The device of claim 1 further comprising means to activate and deactivate the device.

3. The device of claim 1 wherein said manipulable means comprises movable buttons.

4. The device of claim 1 wherein said manipulable means comprises touch pads.

5. The device of claim 1 further comprising means to light each of said manipulable means when said manipulable means are manipulated so that the user can review his or her bid before said bid is transmitted to said display board.

6. The device of claim 1 wherein the means for registering and displaying the plurality of indica comprises light emitting diodes capable of displaying the bidding information which includes the suit bid or no trump, the number of tricks, pass, double, re-double, designation of a jump/skip bid and the use of an unconventional bidding system.

7. The device of claim 1 further comprising a panel means in said housing for gaining access to the interior of said housing means.

8. The device of claim 1 further comprising skid proof means disposed under said housing for the prevention of movement of said device on a playing surface.

9. The device of claim 1 wherein said housing comprising two rectangular boards wherein a longitudinal edge of one board is contiguous with a longitudinal edge of the other board.

10. The device of claim 9 wherein the angle between the two boards is less than 90°.

11. The device of claim 1 wherein said housing is segmented to facilitate compaction for storage and transport.

12. The device of claim 1 wherein said housing is in the form of a polyhedron.

13. The device of claim 12 wherein said polyhedral form is triangular in cross-section.

* * * * *